US006858097B2

(12) United States Patent
Giordani et al.

(10) Patent No.: US 6,858,097 B2
(45) Date of Patent: Feb. 22, 2005

(54) BRIGHTENING/PASSIVATING METAL SURFACES WITHOUT HAZARD FROM EMISSIONS OF OXIDES OF NITROGEN

(75) Inventors: Paolo B. Giordani, Crema (IT); Valentino Gasparetto, Olgiate Molgora (IT); Dario Negri, Bagnolo Cremasco (IT)

(73) Assignee: Henkel Kommanditgesellschaft auf Aktien (Henkel KGAA), Duesseldorf (DE)

( * ) Notice: Subject to any disclaimer, the term of this patent is extended or adjusted under 35 U.S.C. 154(b) by 191 days.

(21) Appl. No.: 10/169,262

(22) PCT Filed: Dec. 21, 2000

(86) PCT No.: PCT/EP00/13088

§ 371 (c)(1),
(2), (4) Date: Jun. 28, 2002

(87) PCT Pub. No.: WO01/49899

PCT Pub. Date: Jul. 12, 2001

(65) Prior Publication Data

US 2003/0121568 A1 Jul. 3, 2003

Related U.S. Application Data

(60) Provisional application No. 60/174,193, filed on Dec. 30, 1999.

(51) Int. Cl.[7] ..... C23C 22/07

(52) U.S. Cl. ..... 148/242; 148/259; 148/260; 148/272; 148/274; 252/388; 252/396

(58) Field of Search ..... 148/242, 259, 148/260, 272, 274; 106/14.11; 252/388, 396

(56) References Cited

U.S. PATENT DOCUMENTS

| | | | | |
|---|---|---|---|---|
| 4,437,928 | A | 3/1984 | Wong | 156/666 |
| 5,354,383 | A | 10/1994 | Bianchi | 134/3 |
| 5,364,549 | A | 11/1994 | McDonogh | 252/79.4 |
| 5,417,775 | A | 5/1995 | Pedrazzini | 148/269 |
| 5,843,240 | A | 12/1998 | Pedrazzini et al. | 134/3 |

FOREIGN PATENT DOCUMENTS

| | | |
|---|---|---|
| EP | 0 816 532 | 1/1998 |
| GB | 1 449 525 | 9/1976 |
| JP | 10-158869 | 6/1998 |
| WO | WO 99/32690 | 7/1999 |

OTHER PUBLICATIONS

English Language Translation of Japanese Patent JP 10–158869 A, Sato et al., Jun. 16, 1998.*

Derwent WPI database. Accession No. 1998–393918 [34], abstract of JP10–158869 (1998).

* cited by examiner

*Primary Examiner*—George Wyszomierski

(74) *Attorney, Agent, or Firm*—Woodcock Washburn LLP

(57) ABSTRACT

A chromium- and nitrogen-free brightening and passivating treatment for metal surfaces, particularly iron and steel, comprises: at least one acid; at least one substance containing a peroxy moiety; and at least one organic substance selected from the group consisting of; molecules that contain both at least one ether moiety and at least one hydroxyl moiety; molecules that contain at least two ether moieties; and molecules that contain in each molecule both at least one ether moiety and one nitrogen atom that is covalently bonded to at least three carbon atoms. Preferably part of the acid contains phosphorus, which has been found to act synergistically with the organic substance to stabilize peroxy compounds against decomposition, particularly in the presence of metal ions.

19 Claims, No Drawings

BRIGHTENING/PASSIVATING METAL SURFACES WITHOUT HAZARD FROM EMISSIONS OF OXIDES OF NITROGEN

This application claims priority from International Application No. PCT/EP00/013088, filed 21 Dec. 2000 and published in English under PCT Article 21(2), and U.S. Provisional Application Ser. No. 60/174,193, filed 30 Dec. 1999, the entire disclosure of each application being incorporated herein by reference in its entirety.

BACKGROUND OF THE INVENTION

"Pickling" is a process applied to metallic surfaces, particularly those of iron and steel but also to various alloys of nickel, copper, and other metals. Usually, pickling is the first chemical treatment applied to a metallic surface after the surface has been formed into the shape and size desired for at least intermediate use by some means that cause the metal surface to be coated with a visible oxide film that may be called "scale", "smut", "discoloration", "oxide", red, white, or black "rust", or some similar term.

The first chemical treatment in a pickling process is generally a concentrated acid or alkaline aqueous solution, for example 10–25% sulfuric, nitric, or hydrochloric acid or 10–40% sodium hydroxide solution. Often such solutions contain an inhibitor that reduces the rate of dissolution of elemental metal without substantially reducing the rate of dissolution of metal oxides. For example, various aromatic amines are very useful inhibitors in acidic pickling solutions and silicate salts are useful inhibitors in alkaline solutions. These concentrated solutions used at the beginning of pickling, however, rarely leave the metal surface in a desirable condition for immediate application of protective coatings of any type. Therefore, the last step of a complete pickling process usually is a chemical treatment operation with at least one and often both of the following two major goals: (a) to obtain a thoroughly clean and bright metallic surface by removing any soil, smut, spots, and/or any other dullness or discoloration formed during or left behind by the primary pickling step and (b) to passivate the metal surface by promoting the formation of a thin oxide or other oxygen-atom-containing layer, with corrosion resistance superior to that of the bare metallic surface, over the metallic surface.

In most instances, both of these goals are achieved by contacting the metal surface after the primary pickling treatment with an oxidizing aqueous solution, such as nitric acid or chromic acid solutions, alone or in mixture with a minor amount of other acids (e.g. HF).

In the more specific case of stainless steel pickling, a major traditional pickling process using mixed $HNO_3$/HF acids includes, after one or more primary pickling operation (s) in which the stainless steel surfaces are contacted with $HNO_3$ (10 to 15%)—HF (2 to 5%) solutions, a final operation in which the metallic surface is contacted with an aqueous liquid, the chemical composition of which is dependent on the type of stainless steel. Generally, this last pickling treatment liquid, which is designated hereinafter as a "brightening and passivating liquid", contains the following ingredients and is used at the following temperatures: $HNO_3$ for mostferritic and/or martensitic grades of stainless steel that are cold and hot rolled, used at a low temperature (<30° C.); $HNO_3$ combined with a very small amount of HF (<1%), used at a low temperature (<30° C.), for specific ferritic and/or martensitic grades that need a little etch to remove the smut from both cold and hot rolled surfaces; and $HNO_3$+HF (1 to 2%) for austenitic grades of stainless steel that have been cold and hot rolled, used at a medium temperature (20–50° C.).

Recently, new pollution-reducing pickling processes utilizing aqueous solutions of sulfuric acid, HF, and $Fe^{3+}$ have been developed to overcome the pollution problems generated by the presence of nitric acid. In such pickling processes, hydrogen peroxide is added to the solution, and/or air or another source of elemental oxygen is blown through the solution, to restore the desired concentration of trivalent iron cations as the latter are depleted by being reduced to divalent iron cations during a pickling process. In practice, hydrogen peroxide is usually used in preference to relying on elemental oxygen alone in such a process, because the amount of elemental oxygen needed and the fact of the existence of elemental oxygen under normal conditions of temperature and pressure only as a gas require that special equipment be provided in many existing plants to prevent losses of pickling solution by entrainment in the large volume of gas flow required through the pickling solution. These new processes give pickling performances fully as satisfactory as those obtained with the traditional high polluting $HNO_3$/HF mixed acid system.

In principle, hydrogen peroxide could be used in such a process by constantly monitoring the oxidation-reduction (hereinafter usually abbreviated as "redox") potential of the solution and adding hydrogen peroxide continuously and only to the extent needed to maintain the potential. In practice, however, many pickling plants are not equipped for such continuous monitoring and addition, so that hydrogen peroxide is added from the beginning of a pickling process and afterwards is replenished only at fairly long time intervals. When so used, hydrogen peroxide needs to be stabilized against spontaneous decomposition in order to achieve the highest possible oxidation reaction yield during the oxidation of bivalent iron to trivalent iron. Many stabilizers for this purpose, such as acetamide, phenacetine, tertiary alcohols, and the like, are known in the art and are available commercially, and many of these stabilizers work quite well when used in the primary stages of pickling.

The main problem in completely eliminating $HNO_3$ from pickling processes using these new pollution-reducing pickling solutions is in the final brightening and passivating liquids. These liquids generally (with some exceptions) have much lower dissolution rates for metal and/or metal scale than do the primary pickling solution(s) used earlier in a pickling process. As a consequence, the brightening and pickling liquids can usually be used for one week up to several months before these liquids accumulate a sufficient concentration of metal ions, dissolved from the surfaces being pickled, to require replacing the brightening and passivating liquids.

Attempts have been made to substitute for $HNO_3$ in traditional brightening and passivating liquids a combination of non-oxidizing acid such as $H_2SO_4$ or $H_3PO_4$ (sometimes with a small amount of HF) with sufficient hydrogen peroxide to achieve a redox potential of the solution of at least about 550 millivolts (this unit being hereinafter usually abbreviated as "mV") more oxidizing than a silver-saturated silver chloride electrode. (The redox potential can be measured, as is known to those skilled in the art, by immersing a chemically inert electrode such as platinum in the solution and measuring, by some method that draws only minimal electric current, the potential of this electrode compared to a standard reference electrode also immersed in the same solution.) Stabilizers of the types listed above have been included in such brightening and passivating liquids, but their useful lives have nevertheless been observed to be very short. As a consequence, in many industrial applications using pollution-reducing primary pickling process as described above, the final brightening and passivating liquid is still an $HNO_3$ or $HNO_3$—HF solution. When a brightening and passivating liquid that does not contain any nitrogenous acid must be used, very high concentrations of hydrogen peroxide are needed to obtain technically satisfactory results, and the costs are very high compared to the traditional process because of rapid spontaneous decomposition of hydrogen peroxide in such high concentrations. This is particularly true in pickling ferritic/martensitic grades of stainless steel, for which the use of a brightening and passivating liquid with a high redox potential is necessary to remove black smut formed during the earlier stage(s) of pickling.

Accordingly, a major object of this invention is to provide technically and economically satisfactory brightening and passivating liquids for completing a pickling process without any need to use nitric acid or any other ingredient that has a hazard of releasing toxic oxides of nitrogen into the environment of the pickling process. Other alternative and/or more detailed objects will become apparent from the detailed description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical, or in fact a stable neutral substance with well defined molecules; the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.; the first definition of an acronym or other abbreviation applies to all subsequent uses of the same acronym or other abbreviation; and the term "paint" and its grammatical variations includes all similar types of coatings that may be described by more specialized names such as "lacquer", "varnish", "primer coat", "top coat", or the like.

BRIEF SUMMARY OF THE INVENTION

It has been found that certain organic substances provide much improved stabilization of hydrogen peroxide in aqueous solutions that contain hydrogen peroxide, which may be introduced into the solutions directly as hydrogen peroxide and/or in the form of other peroxy compounds that are capable of yielding hydrogen peroxide in aqueous solution, particularly when these solutions also contain dissolved metal cations with a valence of two or more, still more particularly when the solutions contain dissolved cations of at least one of iron, nickel, cobalt, chromium, manganese, molybdenum, titanium, and copper. Suitable organic substances for this purpose are selected from the group consisting of:

- substances constituted of molecules that contain both at least one ether moiety and at least one hydroxyl moiety in each molecule;
- substances constituted of molecules that contain in each molecule at least two ether moieties; and
- substances constituted of molecules that contain in each molecule both at least one ether moiety and one nitrogen atom that is covalently bonded to at least two, or preferably at least three, carbon atoms.

Stabilization of the hydrogen peroxide in such solutions can be further improved by a synergistic effect with oxyacids of phosphorus. Brightening and passivating liquids incorporating such stabilizers and free from any concentration of nitrogenous compounds that present a hazard of emissions of toxic oxides of nitrogen into the environment of a pickling process are fully satisfactory for use to complete pickling.

Embodiments of the invention include liquid compositions suitable for brightening and passivating, processes for brightening and passivating, and complete pickling processes incorporating such brightening and passivating.

DETAILED DESCRIPTION OF THE INVENTION AND PREFERRED EMBODIMENTS

A brightening and passivating liquid according to the invention comprises, preferably consists essentially of, or more preferably consists of, water and the following dissolved components:

(A) at least one acid;

(B) at least one substance containing a peroxy moiety; and (C) at least one organic substance selected from the group consisting of:

(1) substances constituted of molecules that contain both at least one ether moiety and at least one hydroxyl moiety in each molecule;

(2) substances constituted of molecules that contain in each molecule at least two ether moieties; and (3) substances constituted of molecules that contain in each molecule both at least one ether moiety and one nitrogen atom that is covalently bonded to at least two, or preferably at least three, carbon atoms; and, optionally, (D) metal cations;

(E) at least one substance that is not part of any of immediately previously recited components (A) through (D)

but is known in prior art as a stabilizer of hydrogen peroxide against decomposition; and (F) at least one surfactant that is not part of any of immediately previously recited components (A) through (E).

Acid component (A) is preferably selected from the group consisting of all acids that are free from nitrogen and have at least one ionization constant, for ionization to produce a hydrogen cation, that is at least $10^{-4}$. More preferably, at least for economy, component (A) is selected from the group consisting of sulfuric, sulfurous, phosphoric and condensed phosphoric, phosphorous and condensed phosphorous, phosphonic, hydrofluoric, and hydrochloric acids. Still more preferably, component (A) consists of or at least comprises a phosphorus-containing acid. At least for economy, this is most preferably orthophosphoric acid.

The total concentration of acid in a brightening and passivating liquid according to the invention may vary over a wide range, depending on the particular metallic surface being treated, the particular acid used, and the preceding pickling treatments. Except possibly for the presence of a phosphorus containing acid as described further below, the particular acid(s) to use and their concentration(s) generally will be the same as for any prior art brightening and passivating process to be replaced, except that any nitrogen containing acid in the brightening and passivating liquid to be replaced should be omitted and a sufficient amount of one of the other acids added to compensate for this omission. Alternatively, a brightening and passivating liquid according to the invention preferably contains a concentration of acid that is at least, with increasing preference in the order given, 1, 3, 5, 7, or 9 grams of acid per liter of total brightening and passivating liquid, this unit being hereinafter usually abbreviated as "g/l", and independently preferably is not more than, with increasing preference in the order given, 500, 400, 300, 200, 175, 150, or 140 g/l.

Even when no phosphorus-containing acid is used in a prior art brightening and passivating liquid and even when some stronger and/or less expensive add than any of the phosphorus-containing acids is desired in a brightening and passivating liquid according to the invention in order to obtain a more rapid action of the brightening and passivating liquid, whenever it is desired to maximize the stability of the peroxy compound component (C) against spontaneous decomposition, some phosphorus containing acid is preferably included in a brightening and passivating liquid according to the invention, because it has been found that such acids have a synergistic effect with component (C) that further stabilizes the peroxy-moiety-containing component (B). For this purpose, at least one phosphorus-containing acid preferably is present in a brightening and passivating liquid according to the invention.

It will be understood by those skilled in the art that instead of adding phosphorus-containing acid(s) directly to make a brightening and passivating liquid according to the invention, it is possible to add salts of the phosphorus-containing acid(s) together with at least one more strongly ionizing acid, which will generate the corresponding phosphorus-containing acids in situ.

Component (B) is preferably selected from the group consisting of hydrogen peroxide, peroxysulfuric acid; peroxycarbonic acid, peroxyboric acid, peroxyphosphoric acid, peroxydiphosphoric acid, and salts of all of the preceding named acids in this sentence. For economy and convenience at least, hydrogen peroxide is most preferred, particularly inasmuch as all of the other materials in this group are believed to function by spontaneously generating hydrogen peroxide (and/or an ion or free radical derivable from hydrogen peroxide) by hydrolysis in aqueous solution. Therefore the concentration of component (B) is measured as the stoichiometric equivalent as hydrogen peroxide of all peroxy-moiety containing substances dissolved in the brightening and passivating liquid. For most pickling processes, this concentration preferably is at least, with increasing preference in the order given, 0.5, 1.0, 1.5, 2.0, 2.5, 3.0, 3.5, 4.0, 4.5, 5.0, or 5.5 g/l and independently preferably, at least for economy, is not more than, with increasing preference in the order given, 50, 40, 30, 25, 20, 18, 16, 14, 12, or 10 g/l. However, if an exceptionally high or low redox potential is needed in a particular brightening and passivating liquid because of treating an unusual type of metallic surface, concentrations of component (B) outside these ranges may be preferred and be used without departing from the invention.

Component (C) is preferably selected from subgroup (C)(1) as described above, i.e., from substances constituted of molecules each of which contains at least one hydroxy moiety and also at least one ether moiety. Such substances more preferably are constituted of molecules having the following characteristics, each preferred characteristic being preferable by itself, independently from the others, and combinations of these preferred characteristics being still more preferable, the overall preference being greater the larger the number of preferred characteristics combined in the molecules:

each molecule has a number of carbon atoms that is at least, with increasing preference in the order given, 3, 4, 5, or 6 and independently preferably is not more than, with increasing preference in the order given, 100, 50, 40, 30, 25, 20, 16, 14, 12, 10, or 8;

each molecule has a number of hydroxyl groups that is not more than, with increasing preference in the order given, 3, 2, or 1; and each molecule has a number of ether moieties that is not more than, with increasing preference in the order given, 50, 40, 30, 25, 20, 15, 10, 8, 6, 4, 3, or 2; and at least one oxygen atom in an ether moiety in each molecule is bonded to a terminal monovalent alkyl group that contains at least 2, or more preferably at least 3, carbon atoms.

Subgroups (C)(2) and (C)(3) are less preferred than (C)(1) primarily for at least one of two reasons: greater expense and/or poorer solubility in brightening and passivating liquids that contain the other required constituents of a brightening and passivating liquid in preferred concentrations according to this invention. Among these two less preferred subgroups, the most preferred are nonionic surfactants with molecules that could be made by ethoxylating fatty alcohols having from 10 to 22 carbon atoms and a single hydroxyl moiety, and then capping the poly(oxyethylene) chain by substituting for the hydrogen atom in the terminal hydroxy moiety an alkyl group or a halo atom. Alkoxylated amines and alkoxylated quaternary ammonium cationic surfactants are next most preferred; these also preferably have at least one, more preferably exactly one, hydrophobe moiety with from 10 to 22 carbon atoms. In order to provide substantial stabilization of hydrogen peroxide when used without any stabilizers constituted of molecules each of which contains both an ether moiety and a hydroxyl moiety, these surfactants need to be present in amounts considerably greater than are normally required for them to exhibit their surfactant activity. However, if otherwise satisfactory brightening and passivating liquids according to the invention are found to need more surfactant activity in order to promote uniform wetting or the like, surfactants of these types are preferably used, in amounts normal for exerting their surfactant properties, rather than other surfactants, which would be part of optional component (F).

The concentration of component (C) in a brightening and passivating liquid according to the invention preferably is at least, with increasing preference in the order given, 0.2, 0.4, 0.6, 0.8, 1.0, 2.0, 3.0, 4.0, or 5.0, g/l and if the brightening and passivating liquid does not include phosphorus-containing acid still more preferably is at least, with increasing preference in the order given, 6.0, 7.0, 8.0, 9.0, or 10.0. Independently, primarily for economy, the concentration of component (C) preferably is not more than, with increasing preference in the order given, 75, 50, 40, 30, 20, or 15 g/l. Also independently, when at least one phosphorus-containing acid is present in a brightening and passivating liquid according to the invention, the mass in the brightening and passivating liquid of all phosphorus-containing acids, measured as their stoichiometric equivalent as $H_3PO_4$, with the stoichiometry being based on equal numbers of phosphorus-containing anions actually or potentially formed by ionization in the aqueous solution, preferably has a ratio to the mass of component (C), measured as its stoichiometric equivalent as $H_2O_2$, both masses being measured in the same unit, that is at least, with increasing preference in the order given, 0.03:1.00, 0.06:1.00, 0.10:1.00, 0.14:1.00, 0.20:1.00, 0.25:1.00, 0.30:1.00, 0.5:1.00, 0.7:1.00, 0.9:1.00, 1.1:1.00, 1.3:1.00, 1.5:1.00, 2.0:1.00, or 2.5:1.00 and independently preferably, primarily for economy, is not more than, with increasing preference in the order given, 100:1.00, 75:1.00, 50:1.00, 40:1.00, 30:1.00, 20:1.00, 15:1.00, 10:1.00, 8:1.00, 6:1.00, 4.0:1.00, 3.5:1.00, or 3.0:1.00.

The invention is most advantageously, and therefore is preferably, applied in brightening and passivating liquids that contain optional component (D) of metal cations. However, such cations need not necessarily be included in the brightening and passivating liquid when it is first prepared, as they will tend to accumulate rapidly in the brightening and passivating liquid during its normal use, as a result of dissolution of such cations from the surfaces being pickled and/or drag-in of such cations from solutions used in earlier parts of an overall pickling process. (In some instances, it is preferred to include such dissolved metal cations in the brightening and passivating liquid when it is prepared, because this will result in performance of the liquid early in its useful life that is more nearly consistent with the performance of the same liquid later in its useful life.)

More specifically, a brightening and passivating liquid according to the invention preferably contains, at some time during its use, a concentration of total component (D), or more preferably a concentration of iron cations alone, that is at least, with increasing preference in the order given, 0.05, 0.10, 0.20, 0.30, 0.40, 0.5, 1.0, 1.5, 2.0, 2.5, 3.0, 3.5, 4.0, 4.5, or 4.9 g/l. The brightening and passivating liquid may contain at least as much as, with increasing preference in the order given, 100, 75, 50, 40, 30, 25, 20, or 15 g/l of component (D) and still function properly according to the invention.

Optional components (E) and (F) of prior art stabilizers and surfactants not part of the previously recited components are usually preferably not present in a brightening and passivating liquid according to the invention. If surfactant activity is needed, a surfactant that can qualify as part of component (C) is preferred, as already discussed above. More particularly, at least for economy (by avoiding the expense of an unnecessary component that could actually damage the performance) a brightening and passivating liquid according to this invention preferably contains not more than, with increasing preference in the order given, 10, 5, 2, 1.0, 0.5, 0.2, 0.05, 0.02, 0.005, 0.002, 0.0005, or 0.0002 percent of any of the following substances, the preference being independent for each substance named: solutes containing the metal tin in either cationic or anionic form; silicates; any organic material that is a chelating agent and is not part of one of the necessary components (A) through (C) as described above; ortho-benzene disulfonic acid; para-hydroxy benzoic acid; allyl alcohol; tertiary-butyl alcohol; picolinic acid; 8-hydroxy quinoline; phenol; acetamide; phenyl acetamide; succinic acid; glutaric acid; and adipic acid.

In a process of brightening and passivating according to the invention, the temperature of the brightening and passivating liquid preferably is maintained during its contact with the metallic surface being brightened and passivated at a temperature that is at least, with increasing preference in the order given, 5, 10, 15, 20, 25, or 29° C. and independently preferably is not more than, with increasing preference in the order given, 60, 55, 50, 45, 40, or 35° C. The time of contact between the brightening and passivating liquid and the metallic surface should be sufficient to achieve the brightening and passivating desired. As a general guideline, the contact time normally preferably is at least, with increasing preference in the order given, 1.0, 2.0, or 3.0 seconds if contact is by spraying and at least, with increasing preference in the order given, 0.2, 0.5, or 1.0 minutes if contact is by immersion. Independently, primarily for economy, the contact time preferably is not more than, with increasing preference in the order given, 200, 150, 100, 75, 50, 40, 30, 20, or 15 seconds if the contact is by spraying and not more than, with increasing preference in the order given, 200, 150, 100, 75, 65, 55, 50, 45, 40, 35, or 30 minutes if the contact is by immersion.

In extended processes according to the invention, a brightening and passivating process according to the invention preferably is combined with one or more primary pickling process steps that also do not have any hazard of generating gaseous toxic nitrogen oxides, or more preferably with a process as described in one or more of International Patent Application WO 99/32690, U.S. Pat. No. 5,843,240 of Dec. 1, 1998 to Pedrazzini et al., U.S. Pat. No. 5,417,775 of May 23, 1995 to Pedrazzini, and U.S. Pat. No. 5,354,383 of Oct. 11, 1994 to Bianchi, the entire disclosures of all of which, to the extent not inconsistent with any explicit statement herein, are hereby incorporated herein by reference.

The invention may be further appreciated from the following examples and comparison examples.

GENERAL CONDITIONS FOR THE EXAMPLES AND COMPARISON EXAMPLES

Unless otherwise specified below, in all the experimental data concerning the stability of hydrogen peroxide: the concentration of residual hydrogen peroxide in actual or candidate brightening and passivating liquids after the passage of time since the liquid was prepared was measured by permanganometric titration; the concentration specified for hydrogen peroxide or any other chemical substance whether identified by name or formula was for the pure compound; any otherwise unspecified balance of any liquid was water; and the temperature of the liquid during the time after which the concentration of residual hydrogen peroxide was measured was constantly maintained at 30±1° C. by a Haake thermostat. (Temperature can have a great influence on the stability of hydrogen peroxide; this temperature was selected because it is quite representative of most industrial applications for a brightening and passivating solution when used as a final metal treatment operation in a pickling process.)

Comparison Example Group 1

This group was intended to measure the effect of iron on the stability of hydrogen peroxide in a candidate brightening and passivating liquid that contained a conventional stabilizer for hydrogen peroxide. The starting solutions initially contained: 20 g/l of sulfuric acid, 9.2–9.5 g/l of $H_2O_2$, 5 g/l of HF, and 16 parts of phenacetine per million parts of total liquid. One of the solutions tested, designated as Comparison Example 1.1, contained no other ingredients except water; the other solution, designated as Comparison Example 1.2, also contained 5 g/l of $Fe^{+3}$, supplied to the liquid as ferric sulfate. The concentration of hydrogen peroxide was checked after 20 hours, and results are shown in Table 1 below.

TABLE 1

| Solution | Percent Reduction in $H_2O_2$ Concentration |
|---|---|
| Comparison Example 1.1 | 0 |
| Comparison Example 1.2 | >80 |

Example and Comparison Example Group 2

For this group all of the solutions contained the following ingredients: 20 g/l of sulfuric acid; 10 g/l of $H_2O_2$; 5 g/l of HF; 5 g/l of $Fe^{+3}$, supplied to the liquid as ferric sulfate, and, except for the comparison examples, 1.67 g/l of the particular substance constituted of molecules each of which contains at least one ether moiety and at least one hydroxyl moiety shown in Table 2. Comparison Example 2.2 also contained 4.5 milligrams of phenacetine per liter of solution. The solutions were maintained for a period of 24 hours at 30° C., after which time the residual hydrogen peroxide was measured. Results are shown in Table 2. These results indicate that all of the Examples are better than both of the Comparison Examples, and the Examples are increasingly better in order from 2.1 to 2.4.

TABLE 2

| Concentration, in g/l, of $H_2O_2$: | Comparison Example 2.1 | Comparison Example 2.2 | Example 2.1 with Ethylene glycol, Monomethyl Ether | Example 2.2 with Ethylene Glycol, Monoethyl Ether | Example 2.3 with Ethylene Glycol, Mono n-Butyl Ether | Example 2.4 with Diethylene Glycol, Mono n-Butyl Ether |
|---|---|---|---|---|---|---|
| Initially | 10.5 | 10.3 | 10.5 | 10.5 | 10.5 | 10.5 |
| After 24 Hours | 0.9 | 0.7 | 8.2 | 9.2 | 9.9 | 10.2 |

Notes for Table 2
Ethylene Glycol, Mono n-Butyl Ether is also known as "Butyl Cellosolve ™" and may be abbreviated hereinafter as "BCS", and Diethylene Glycol, Mono n-Butyl Ether is also known as "Butyl Carbitol" and may be abbreviated hereinafter as "BTC".

Example Group 3

Fluoride ions form strong complexes with iron cations that might reasonably be expected to have an effect on the stability of hydrogen peroxide in aqueous solutions that also contain iron. Therefore, in this group, materials and compositions were like those of Group 2, except for the absence of fluoride. For this group all of the solutions contained the following ingredients: 20 g/l of sulfuric acid; 10 g/l of $H_2O_2$; 5 g/l of $Fe^{+3}$, supplied to the liquid as ferric sulfate, and a concentration of diethylene glycol, mono-n-butyl ether as indicated in Table 3. The results there show that in the absence of fluoride, more BTC is needed to achieve even moderate stability than in the presence of fluoride in Group 2, but there is little if any increase in stability for BTC concentrations greater than about 10 g/l.

Comparison Example Group 4

In this group, phosphoric acid was included in the brightening and passivating liquid as an alternative to a glycol monoether substance. All of the solutions included the following ingredients: 20 g/l of sulfuric acid; 10 g/l of $H_2O_2$; 5 g/l of $Fe^{+3}$,

TABLE 3

| Percent of Original $H_2O_2$ | Concentration of BTC, g/l | | | | | |
|---|---|---|---|---|---|---|
| Remaining After: | 1.67 | 2.1 | 4.2 | 8.4 | 14.4 | 29 |
| 24 Hours | 0.0 | 20 | 44 | 46 | 48 | 48 |
| 48 Hours | 0.0 | 0.0 | 6.7 | 11.4 | 19.0 | 19.0 |

supplied to the liquid as ferric sulfate, and a concentration of $H_3PO_4$ as shown in Table 4; the entry "n.d." means "not determined". These results indicate that phosphoric acid alone has a slight inhibiting effect, but it is much weaker than that of glycol monoethers.

TABLE 4

| $H_3PO_4$ Addition, | Percent Residual Active $H_2O_2$ in Solution After: | | | |
|---|---|---|---|---|
| g/l | Initially | 2 Hours | 12 Hours | 24 Hours |
| 0.0 | 100 | 0 | 0 | 0 |
| 10 | 100 | n.d. | 50 | 0 |
| 20 | 100 | n.d | 55 | 7.0 |
| 30 | 100 | n.d | 60 | 16.0 |

Example Group 5

In this group, the solutions were the same as in Group 4, except that each solution also contained 5 g/l of BTC and the amounts of phosphoric acid were as shown in Table 5. In the rightmost column of Table 5 are results for a solution treated in the same manner as the others except that air was blown through it during the aging of the solution. It is evident by comparison with previous tables that the stability achieved in this group is far better than that achieved by either BTC or phosphoric acid alone. Also, there was little or no effect of the air blowing on the stability results.

Example and Comparison Example Group 6

In this group, sulfuric acid was omitted. Each solution contained 34 g/l of phosphoric acid; 10 g/l of $H_2O_2$; 5 g/l of $Fe^{+3}$, supplied to the liquid as ferric sulfate, and, for the example only, a concentration of 5.0 g/l of BTC. Results are shown in Table 6. These results show that the stability is even better than in the presence of

TABLE 5

| Percent of Initial $H_2O_2$ Remaining | Concentration of $H_3PO_4$ in g/l | | | | |
|---|---|---|---|---|---|
| after: | 0 | 5 | 15 | 25 | 25 (Air) |
| 0 Hours | 100 | 100 | 100 | 100 | 100 |
| 24 Hours | 50 | 83 | 98 | 100 | 100 |
| 48 Hours | 16.7 | 65 | 93 | 97 | 96 |
| 72 Hours | 0.0 | 48 | 88 | 95 | 92 |
| 192 Hours | 0.0 | 15.3 | 70 | 81 | 85 |

sulfuric acid. However, this kind of solution is more expensive and slower to remove heavy scale than the sulfuric-acid containing solutions in preceding examples. It could be advantageously used on low chromium grades of steel that are readily attacked by sulfuric acid; in this instance, the use of phosphoric acid as the only acid strongly reduces the etching and provides passivation at the same time.

TABLE 6

| | Percent of Initial $H_2O_2$ Remaining after: | | |
|---|---|---|---|
| | 0 Hours | 24 Hours | 48 Hours |
| Comparison | 100 | 72 | 48 |
| Example | 100 | 100 | 97 |

Example and Comparison Example Group 7

In this group, a phosphonate was used instead of phosphoric acid. Thephosphonate was BAYBHIT™ PBS-AM, a commercial product reported by its supplier to be a phosphonate that is stable and soluble in hydrogen peroxide solutions. In the comparison examples shown in Table 7.1, each solution contained: 20 g/l of sulfuric acid; 10 g/l of $H_2O_2$; 5.0 g/l of $Fe^{+3}$, supplied to the liquid as ferric sulfate, and a concentration of phosphonate as shown in Table 7.1. In the examples according to the invention shown in Table 7.2, each solution contained the same ingredients as for the examples in Table 7.1 and also contained 2.0 g/l of BTC. The results are shown in the Tables below; they indicate that even the relatively small amount of glycol monoether in the Examples considerably increases the long term stability of the hydrogen peroxide in these solutions.

TABLE 7.1

| Percent of Initial $H_2O_2$ Remaining | Concentration of Phosphonate in the Solutions | | | | |
|---|---|---|---|---|---|
| after: | 0.0 | 4 g/l | 8 g/l | 12 g/l | 16 g/l |
| 0.0 Hours | 100 | 100 | 100 | 100 | 100 |
| 2.0 Hours | 0 | n.d | n.d. | n.d. | n.d. |
| 16 Hours | 0 | 2.4 | 36 | n.d. | n.d. |

TABLE 7.1-continued

| Percent of Initial $H_2O_2$ Remaining | Concentration of Phosphonate in the Solutions | | | | |
|---|---|---|---|---|---|
| after: | 0.0 | 4 g/l | 8 g/l | 12 g/l | 16 g/l |
| 24 Hours | 0 | 0 | 0.0 | 61 | 72 |
| 48 Hours | 0 | 0 | 0.0 | 0.0 | 38 |

TABLE 7.2

| Percent of Initial $H_2O_2$ Remaining | Concentration of Phosphonate in the Solutions | | | |
|---|---|---|---|---|
| after | 0.0 | 2.5 g/l | 5.0 g/l | 10.0 g/l |
| 0.0 Hours | 100 | 100 | 100 | 100 |
| 24 Hours | 18.0 | 54 | 65 | 77 |
| 28 Hours | 0 | n.d. | n.d. | n.d. |
| 48 Hours | 0 | 0 | 0.0 | 61 |

Example Group 8

In this group additional glycol monoethers were tested. Each solution contained: 20 g/l of sulfuric acid; 10 g/l of $H_2O_2$; 5 g/l of $Fe^{+3}$, supplied to the liquid as ferric sulfate, and a concentration of glycol ether as shown in Table 8, which also shows the stability results. All of these glycol monoethers tested showed a stabilizing behavior.

Example and Comparison Example Group 9

In this group, a series of four brightening and passivating liquids was studied to simulate the aging of a type of treatment commercially used for American Iron and Steel Institute (this organization being hereinafter usually abbreviated as "AISI") Type 409 Stainless Steel. The concentrations of at least one of fluoride and iron cations were increased from one solution to the next. The compositions of the four base solutions are shown in Table 9.0.

TABLE 8

| Glycol Monoether Characteristics | | | Percent Residual $H_2O_2$ after: | |
|---|---|---|---|---|
| Tradename | Chemical Description | Concentration, g/l | 24 Hours | 48 Hours |
| DOWANOL ™ DPM | Dipropylene glycol, mono methyl ether | 2 | n.d | 3.4 |
| DOWANOL ™ TPM | Tripropylene glycol, monomethyl ether | 2 | 14 | 2 |
| DOWANOL ™ PnP | Propylene glycol, mono-n-propyl ether | 5 | n.d | 32 |
| DOWANOL ™ DPnP | Dipropylene glycol, mono-n-propyl ether | 2 | n.d | 24 |
| | | 5 | n.d | 24.5 |
| DOWANOL ™ PnB | Propylene glycol, mono-n-butyl ether | 5 | 54 | 18.7 |
| DOWANOL ™ DPnB | Dipropylene glycol, mono-n-butyl ether | 5 | 48.5 | 7.7 |
| DOWANOL ™ DB | Diethylene glycol, mono-n-butyl ether | 5 | 59.4 | 28 |
| DOWANOL ™ EB | Ethylene glycol, mono-n-butylether | 5 | 50 | 24 |

TABLE 9.0

| Ingredient | Grams of Ingredient per Liter of Solution: 9.1 | 9.2 | 9.3 | 9.4 |
|---|---|---|---|---|
| $H_2SO_4$ | 30 | 30 | 30 | 30 |
| HF | 0.0 | 10.0 | 15.0 | 20 |
| $H_2O_2$ | 5.6 | 5.6 | 5.6 | 5.6 |
| $Fe^{+3}$ | 5.0 | 5.0 | 10.0 | 15.0 |

To make brightening and passivating liquids according to the invention, varying amounts of a mixture containing equal parts by weight of BCS and $H_3PO_4$ were added to these base solutions in amounts shown in Tables 9.1–9.4, and the percentages of the initial concentration of hydrogen peroxide found after various times of aging at 30° C. were determined. The results are shown in Table 9.1 for brightening and passivating liquids made with base solution 9.1, in Table 9.2 for brightening and passivating liquids made with base solution 9.2, in Table 9.3 for brightening and passivating liquids made with base solution 9.3, and in Table 9.4 for brightening and passivating liquids made with base solution 9.4.

Example and Comparison Example Group 10

In this group stabilizers that were not glycol monoethers were tested. Each solution contained: 20 g/l of sulfuric acid; 10 g/l of $H_2O_2$; 5 g/l of $Fe^{+3}$, supplied to the

TABLE 9.1

| Percent of Initial $H_2O_2$ Remaining after the Following Numbers of Hours | Concentration of Mixture of BCS and $H_3PO_4$ in the Solutions: 0.0 g/l | 2.1 g/l | 4.3 g/l | 8.6 g/l |
|---|---|---|---|---|
| 0.0 | 100 | 100 | 100 | 100 |
| 2.0 | 48 | n.d. | n.d. | n.d. |
| 4.0 | 19 | n.d. | n.d. | n.d. |
| 6.0 | 9.5 | 91 | 96 | 95 |
| 16 | 0.0 | n.d. | n.d. | n.d. |
| 24 | n.d. | 49 | 75 | 79 |
| 32 | n.d. | 0.0 | 66 | n.d. |
| 48 | n.d. | n.d. | 42 | 61 |
| 54 | n.d. | n.d. | 26 | n.d. |
| 64 | n.d. | n.d. | 0.0 | n.d. |
| 72 | n.d. | n.d. | n.d. | 46 |
| 96 | n.d. | n.d. | n.d. | 32 |
| 102 | n.d. | n.d. | n.d. | 14.0 |

liquid as ferric sulfate, and a concentration of stabilizer as shown further below. Stabilizer substances tried included:

poly(ethylene glycols) with the chemical formula OH—$(CH_2CH_2O)_n$—H, where n represents a positive integer in each molecule, but may have an average value that is non-integral; materials with weight average molecular weights of 400 and 4000, which are designated as "PEG" 400 and 4000 respectively, were specifically used;

ROLAMET™ C11, with the formula:

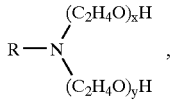

where (x+y)=11 and R is a $C_{12}$ to $C_{14}$ aliphatic moiety;

BEROL™ 556, which is reported by its supplier to have the general formula:

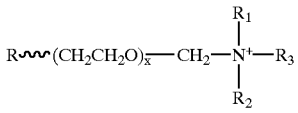

TABLE 9.2

| Percent of Initial $H_2O_2$ Remaining after the Following Numbers of Days | Concentration of Mixture of BCS and $H_3PO_4$ in the Solutions: 0.0 g/l | 2.1 g/l | 4.3 g/l | 8.6 g/l |
|---|---|---|---|---|
| 0.00 | 100 | 100 | 100 | 100 |
| 0.66 | 24 | n.d. | n.d. | n.d. |
| 0.83 | 16 | n.d. | n.d. | n.d. |
| 1.00 | 12 | 100 | 100 | n.d. |
| 1.50 | 0 | n.d. | n.d. | n.d. |
| 2.0 | n.d. | 99 | 100 | n.d. |
| 3.0 | n.d. | 98 | 99 | n.d. |
| 4.0 | n.d. | n.d. | 96 | 96 |
| 5.0 | n.d. | 90 | n.d. | 95 |
| 6.0 | n.d. | 8.5 | 89 | 94 |
| 7.0 | n.d. | 0 | 81 | 90 |
| 8.0 | n.d. | n.d. | 71 | 86 |
| 9.0 | n.d. | n.d. | 9.5 | 80 |
| 10.0 | n.d. | n.d. | 0.0. | n.d. |
| 11.0 | n.d. | n.d. | n.d. | 58 |
| 12.0 | n.d. | n.d. | n.d. | 41 |
| 13.0 | n.d. | n.d. | n.d. | 19 |
| 14.0 | n.d. | n.d. | n.d. | 0 |

where R is believed to represent a $C_{13}$ to $C_{15}$ aliphatic moiety, X has an average value from 4 to 5, and each of $R_1$, $R_2$, and $R_3$ is believed to represent a methyl or ethyl moiety;

TRITON™ DF 16, which is reported by its supplier to conform to the general formula: R—$(C_2H_4O)_n$ $CH_2CH_2OR'$, where R is believed to be a monovalent aliphatic moiety with from 14 to 18 carbon atoms, n to be a positive integer for each individual molecule with an average value of about 16, and R' to be a short capping moiety; and QUAFIN™ CT, which is reported by its supplier to be a benzyl dimethyl ammonium chloride, with the fourth moiety bonded to the nitrogen atom believed to be an aliphatic hydrophobe moiety with from 10 to 16 carbon atoms.

TABLE 9.3

| Percent of Initial $H_2O_2$ Remaining after the Following Numbers of | Concentration of Mixture of BCS and $H_3PO_4$ in the Solutions | | | |
|---|---|---|---|---|
| Hours | 0.0 g/l | 2.1 g/l | 4.3 g/l | 8.6 g/l |
| 0.0 | 100 | 100 | 100 | 100 |
| 2.0 | 71 | n.d. | n.d. | n.d. |
| 4.0 | 46 | n.d. | n.d. | n.d. |
| 6.0 | 30 | n.d. | n.d. | n.d. |
| 16 | 9.0 | 95 | n.d. | n.d. |
| 24 | 0.0 | 94 | 93 | n.d. |
| 48 | n.d. | 80 | 87 | 87 |
| 72 | n.d. | 0.0 | 73 | 79 |
| 96 | n.d. | n.d. | 56 | 69 |
| 114 | n.d. | n.d. | 27 | n.d. |
| 120 | n.d. | n.d. | n.d. | 55 |
| 131 | n.d. | n.d. | 0.0 | n.d. |
| 144 | n.d. | n.d. | n.d. | 36 |
| 150 | n.d. | n.d. | n.d. | 31 |

Conditions of testing and the results of the tests are shown in Table 10. All except the last row in the Table represent examples according to the invention; the last row is a comparison example, because the "stabilizer" does not contain any oxygen atoms.

Example And Comparison Example Group 11

In an industrial plant using a nitric acid based passivation operation as the end of a pickling process for ferritic-martensitic alloy steels containing 8 to 9% of chromium, red fumes were emitted and the entire volume of the tank had to be replaced every day. This unsatisfactory comparison example was replaced by an example according to the present invention that contained 10 g/l of $H_3PO_4$, 10 g/l of butyl carbitol, and 10 g/l of $H_2O_2$. With this brightening and passivating liquid according to the invention, about 800 tons of ferritic/martensitic and other even less noble steels were brightened and passivated in a single volume over 10 working days without any replacement. After this time, the concentration of hydrogen peroxide was more than 95% of the starting concentration. The surface quality of all of the pickled surfaces was very good.

TABLE 9.4

| Percent of Initial $H_2O_2$ Remaining after the Following Numbers of | Concentration of Mixture of BCS and $H_3PO_4$ in the Solutions | | | |
|---|---|---|---|---|
| Hours | 0.0 g/l | 2.1 g/l | 4.3 g/l | 8.6 g/l |
| 0 | 100 | 100 | 100 | 100 |
| 2 | 58.2 | n.d. | n.d. | n.d. |
| 4 | 33.7 | n.d. | n.d. | n.d. |
| 16 | 5.3 | 90 | 92 | 90 |
| 24 | 0 | 82 | 86 | n.d. |
| 40 | n.d. | 0.0 | 75 | 76 |
| 48 | n.d. | n.d. | 67 | n.d. |
| 65 | n.d. | n.d. | 31 | 54 |
| 72 | n.d. | n.d. | 0 | 24 |

TABLE 9.4-continued

| Percent of Initial $H_2O_2$ Remaining after the Following Numbers of | Concentration of Mixture of BCS and $H_3PO_4$ in the Solutions | | | |
|---|---|---|---|---|
| Hours | 0.0 g/l | 2.1 g/l | 4.3 g/l | 8.6 g/l |
| 96 | n.d. | n.d. | n.d. | 15 |
| 102 | n.d. | n.d. | n.d. | 14 |

TABLE 10

| Stabilizer | Concentration, g/l | Temperature, ° C. | Percent of Original $H_2O_2$ Remaining after: 5 Hours | 24 Hours | 48 Hours | 72 Hours |
|---|---|---|---|---|---|---|
| PEG 400 | 10 | 30 | 60 | 15 | n.d. | n.d. |
| | | 20 | n.d. | 62 | n.d. | n.d. |
| PEG 4000 | 10 | 30 | n.d. | 15 | n.d. | n.d. |
| ROLA- | 2.5 | 30 | n.d. | 67 | 0.0 | n.d. |
| MET ™ | 5.0 | | n.d. | 74 | 33 | 0.0 |
| C11 | 10.0 | | n.d. | 70 | 33 | 14 |
| BEROL ™ | 10.0 | 20 | n.d. | 85 | 70 | 42 |
| 556 | 2.5 | 30 | n.d. | 0.0 | n.d. | n.d. |
| | 5.0 | | n.d. | 49 | 15 | 0.0 |
| | 10.0 | | n.d. | 65 | 35 | 11.8 |
| TRITON ™ | 10.0 | 20 | n.d. | 93 | 80 | 60 |
| DF-16 | 10.0 | 30 | No determination was meaningful, because the mixture was inhomogeneous. | | | |
| | 2.5 | | | | | |
| QUAFIN ™ CT | 10.0 | 20 | 0.0 | n.d. | n.d. | n.d. |

Example and Comparison Example Group 12

For this group the comparison example was a pickling/passivation liquid that contained 120 g/l of $HNO_3$ and 40 g/l of HF and was used at the end of an industrial pickling cycle for austenitic stainless steels that contained 3 to 5% of copper. Enough of this copper was dissolved during the earlier stages of pickling to result in the presence in solution of a concentration of 1 to 2 g/l of $Cu^{2+}$ in these solutions used in earlier stages of pickling. The presence of copper in these solutions makes possible a deposition of elemental copper that remains on the surfaces of some of some austenitic stainless steel alloys, such as AISI Type 303 Stainless Steel, after completion of the earlier stages of pickling. The use of a high oxidizing power solution at the end of the total pickling process removes any such copper.

In the example according to the invention, the high oxidizing power solution contained 100 g/l of $H_2SO_4$, 40 g/l of HF, 15 g/l of hydrogen peroxide, 5 g/l of $H_3PO_4$, and 5 g/l of BCS=5 g/l. The operating temperature of this brightening and passivating liquid was maintained within the range from 20 to 30° C., and air was blown into the bath to agitate it and thereby favor a uniform activity of the solution on the whole surface.

The contact time of the metallic surfaces treated in this bath was about 15 minutes. During one week, about 1500 tons of different grades of austenitic stainless steel wire and rod with diameters ranging from 5.5 mm to 24 mm were pickled in a three stage overall pickling process in which the treatment with the brightening and passivating liquid according to the invention was the last stage. No hydrogen peroxide, BCS, or phosphoric acid was added to the bath during this period.

At the end of this one week of processing, the concentration of copper in the treatment solution for the first stage was about 0.7 g/l and in the treatment solution for the second stage was about 1.5 g/l. However, the surfaces emerging from the third stage treatment according to the invention were observed both visually and by energy-dispersive-X-ray analysis, and no copper was detected by either method. The hydrogen peroxide concentration in the brightening and passivating liquid after this one week was still 13 g/l.

What is claimed:

1. A brightening and passivating liquid composition, comprising water and the following dissolved components:

(A) a phosphorus-containing acid and at least one acid selected from the group consisting of sulfuric, sulfurous, hydrofluoric, and hydrochloric acids;

(B) at least one substance containing a peroxy moiety; and (C) at least one organic substance selected from the group consisting of:

(1) a compound having both at least one ether moiety and at least one hydroxyl moiety;

(2) a compound having at least two ether moieties; and (3) a compound having at least one ether moiety and one nitrogen atom that is covalently bonded to at least three carbon atoms.

2. The composition of claim 1, wherein the ratio of phosphorous-containing acid to component (C) is from 0.03:1.00 to 8:1.00 by mass.

3. The composition of claim 1, wherein the concentration of component (A) is from 1 to 500 g/l, and the concentration of component (C) is from 0.4 to 75 g/l.

4. The composition of claim 1, wherein said at least one organic substance is subgroup (C)(1), having from 3 to 30 carbon atoms, not more than 3 hydroxyl groups, and wherein at least one oxygen atom in said ether moiety is bonded to a terminal monovalent alkyl group that contains at least 2 carbon atoms.

5. The composition of claim 1, wherein:

the ratio of phosphorous-containing acid to component (C) is from 0.7:1.00 to 6:1.00 by mass;

the concentration of component (A) is from 9 to 140 g/l, and the concentration of component (C) is from 5 to 30 g/l; and said at least one organic substance is subgroup (C)(1), having from 4 to 10 carbon atoms, not more than 1 hydroxyl group, and wherein at least one oxygen atom in said ether moiety is bonded to a terminal monovalent alkyl group that contains at least 2 carbon atoms.

6. The composition of claim 1, wherein at least part of component (C) is a compound selected from the group consisting of ethylene glycol monomethyl ether, ethylene glycol monoethyl ether, ethylene glycol mono-n-butyl ether, diethylene glycol mono-n-butyl ether, dipropylene glycol monomethyl ether, tripropylene glycol monomethyl ether, propylene glycol mono-n-propyl ether, dipropylene glycol mono-n-propyl ether, propylene glycol mono-n-butyl ether, dipropylene glycol mono-n-butyl ether and mixtures thereof.

7. The composition of claim 1, wherein at least part of component (C) is a polyethylene glycol.

8. The composition of claim 1, wherein at least part of component (B) is hydrogen peroxide.

9. The composition of claim 1, wherein there is a concentration of component (C) that is from 1.0 to 30 g/l.

10. The composition of claim 1, wherein at least part of component (A) is sulfuric acid, at least part of component (B) is hydrogen peroxide, and said composition is free from nitric acid.

11. The composition of claim 10, wherein at least part of component (A) is hydrofluoric acid.

12. The composition of claim 1, wherein at least part of component (C) is a nonionic surfactant made by ethoxylating a fatty alcohol having from 10 to 22 carbon atoms and a single hydroxyl moiety to form a poly(oxyethylene) chain having a terminal hydroxyl moiety and substituting an alkyl group or halo atom for the hydrogen atom in the terminal hydroxyl moiety.

13. The composition of claim 1, wherein at least part of component (C) is selected from the group consisting of alkoxylated amines and alkoxylated quaternary ammonium cationic surfactants.

14. A process of brightening and passivating a metallic surface by contacting said surface with the brightening and passivating liquid of claim 1.

15. The process of claim 14, wherein the brightening and passivating liquid contains a transient concentration of at least 2.5 g/l of metal ions.

16. The process of claim 14, wherein the brightening and passivating liquid is maintained during its contact with the metallic surface being brightened and passivated at a temperature of 20° to 50° C.

17. The process of claim 14, wherein said contacting is by immersion or by spraying, and the contact time is not more than 30 seconds if contacting by spraying or not more than 30 minutes if contacting by immersion.

18. A process of brightening and passivating a metallic surface comprising contacting said surface with the brightening and passivating liquid composition of claim 5.

19. A brightening and passivating liquid composition, comprising water and the following dissolved components:

(A) at least one acid comprising phosphoric acid;

(B) at least one substance containing a peroxy moiety, wherein said liquid composition contains less than about 20 g/l hydrogen peroxide; and (C) at least one organic substance selected from the group consisting of:

(1) a compound having both at least one ether moiety and at least one hydroxyl moiety;

(2) a compound having at least two ether moieties; and (3) a compound having at least one ether moiety and one nitrogen atom that is covalently bonded to at least three carbon atoms.

* * * * *